US007244153B2

(12) United States Patent
Lobrovich

(10) Patent No.: US 7,244,153 B2
(45) Date of Patent: Jul. 17, 2007

(54) PROPELLER COVER

(76) Inventor: Stephen B. Lobrovich, 643 Becado Pl., Fremont, CA (US) 94539

( * ) Notice: Subject to any disclaimer, the term of this patent is extended or adjusted under 35 U.S.C. 154(b) by 311 days.

(21) Appl. No.: 11/088,347

(22) Filed: Mar. 23, 2005

(65) Prior Publication Data

US 2005/0214126 A1 Sep. 29, 2005

Related U.S. Application Data

(60) Provisional application No. 60/555,799, filed on Mar. 23, 2004.

(51) Int. Cl.
*B63H 5/16* (2006.01)
*B65D 85/00* (2006.01)

(52) U.S. Cl. ..... 440/71; 150/157
(58) Field of Classification Search ..... 440/71
See application file for complete search history.

(56) References Cited

U.S. PATENT DOCUMENTS

D322,593 S * 12/1991 Kearney et al. ..... D12/214
5,246,345 A * 9/1993 Adams, Jr. ..... 416/247 A
D344,456 S * 2/1994 Argondizza ..... D9/420
D372,079 S * 7/1996 Fago et al. ..... D23/365
5,664,975 A * 9/1997 Carlisle ..... 440/49
6,916,217 B1 * 7/2005 Crepeau ..... 440/71

* cited by examiner

*Primary Examiner*—Jesús D. Sotelo
(74) *Attorney, Agent, or Firm*—Gregory Scott Smith; GSS Law Group

(57) ABSTRACT

An inexpensive easy to use and reusable propeller blade cover. The blade cover of the invention may be used on many kinds and sizes of propeller blades, but are particularly suited for use on boat propellers, and can used to prevent damage to property and protect individuals from injury due to unintended contact with an uncovered boat propeller. The propeller covers of the invention may also be used to display advertising.

19 Claims, 9 Drawing Sheets

PROPELLER COVER

REFERENCE TO CROSS-RELATED APPLICATIONS

This application claims the benefit of provisional application No. 60/555,799 filed on Mar. 23, 2004.

FIELD OF THE INVENTION

The invention is in the filed of propeller covers which may be used to prevent damage to property or persons caused by contact with the propeller blades, and also to prevent damage to the propeller blades.

BACKGROUND OF THE INVENTION

Many kinds of propellers, but particularly boat propellers can pose a danger to property and persons that come into contact with the uncovered propellers. For example, boat owners typically cover their boats when storing them. Many kinds of propeller blades, but particularly the propeller blades used on trolling motors, may cause tears in the boat covers and tarps used to cover the boats when stored. When the boat is out of water the blades can also cause injury to individuals who may bump or fall against the uncovered propeller of a boat motor, or to personal property that inadvertently contacts the propeller.

In the past individuals have resorted to covering the blades with rags or towels. However, the towels do not always stay where placed and often look messy. What is needed is an inexpensive easy to use and reusable propeller blade cover that can prevent damage to property and protect individuals from injury due to unintended contact with an uncovered boat propeller.

BRIEF SUMMARY OF THE INVENTION

The invention includes an inexpensive easy to use and reusable propeller blade cover. The propeller blade cover of the invention may be used on many kinds and sizes of propeller blades, but are particularly suited for use on boat propellers, and most particularly for use on trolling motor propellers.

In one embodiment the invention comprises a front plate with an edge, and a flange formed around the edge of the front plate. The flange defines a channel intended to receive the blades of a propeller. At least one notch is provided in the channel to allow the blades access to the channel. In some embodiments there is a notch for each blade on the propeller. In some embodiment, only the tip of each blade is received within the channel. In some embodiments, there is an interference fit between the blade and the flange that creates friction resistance to rotation of the cover relative to the blades, so that the cover does not inadvertently rotate to a position aligning the blades with the notches, allowing the cover to fall of the propeller.

In some embodiments, the propeller cover includes ridges or apertures in any combination formed therein. The ridges may be of any size, shape, and number, and may be used to stiffen or strengthen the propeller cover and/or may be decorative in function. The apertures or holes formed in the propeller cover may be of any size, shape, and number, and may provide benefits which include but are not limited to: reducing the weight of the propeller cover, providing decorative or ornamental design features, reducing cost by reducing the volume of material use to fabricate the propeller cover, and allowing airflow through the propeller cover.

In some embodiments, the propeller cover is made in a selection of sizes to fit a variety of propellers. In a further embodiment of the invention, moveable brackets are positioned by the user on the back surface of the front plate so that a single propeller cover can be adapted by the user to fit a variety of sizes of propeller.

In some embodiments, the propeller cover may further comprise advertising. In other embodiments, the propeller cover may include one or more decorative shapes or objects coupled to the propeller cover. In still other embodiments, the propeller cover of the invention may be incorporated into a decoratively shaped object, allowing the decoratively shaped object to be attached to the propeller blade.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The invention includes an inexpensive easy to use and reusable propeller blade cover. The propeller cover of the invention may be used on many kinds and sizes of propeller.

An example propeller cover will be described for use on a trolling motor propellers of the kind commonly used by bass fishermen, however, the invention is not limited to use on this kind of propeller.

Figure 1:
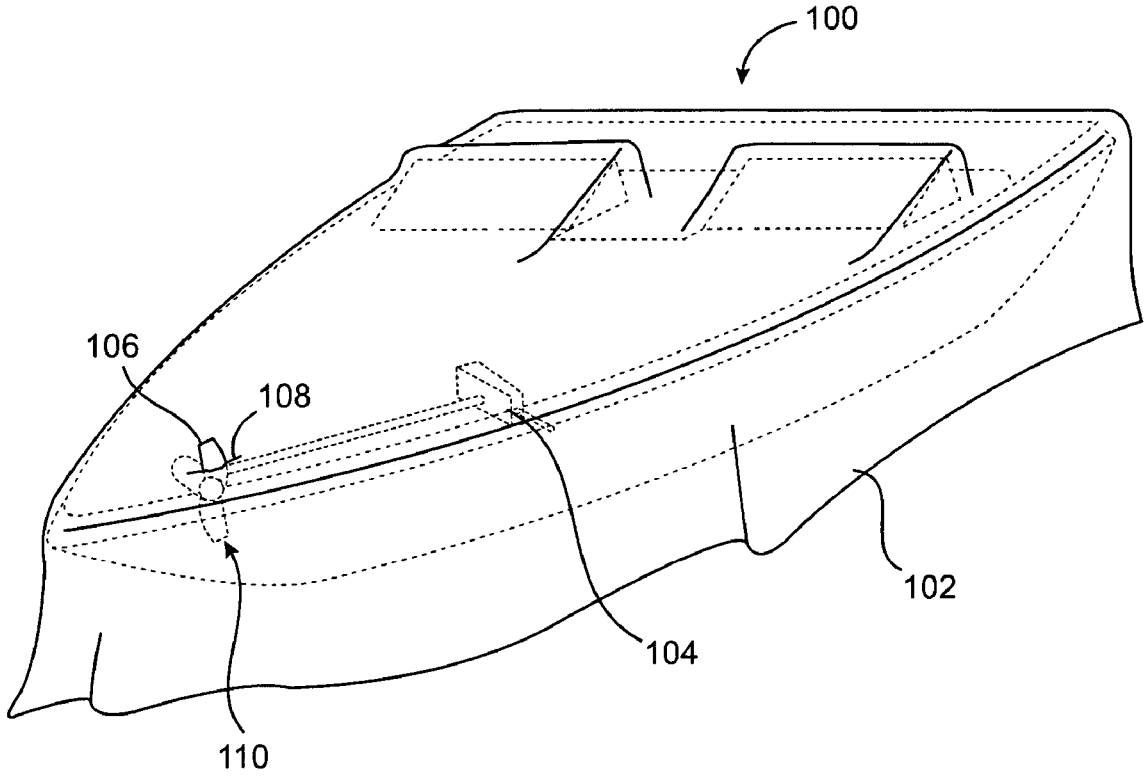
FIG. 1 (Prior Art)
FIG. 1 shows a typical trolling motor mounted on a boat covered with a boat cover, and with a blade of the propeller sticking through a tear in the boat cover.

FIG. 1 shows a typical trolling motor 104 mounted on a boat 100 covered with a boat cover 102, and with a blade 106 of the propeller 110 sticking through a tear 108 in the boat cover 102. The trolling motors 104 are intended to assist the boats 100 on which they are installed in moving nimbly in any direction. Trolling motors often fold upwards onto the top of the boat 100 as shown, which makes contact with the boat cover 102 or accidental contact with other property or with people very likely. The exposed blades 106 of the propeller 110 of the trolling motor 104 contact the boat cover 102, and can wear, cut, or rip a hole in the boat cover 102.

Figure 2:
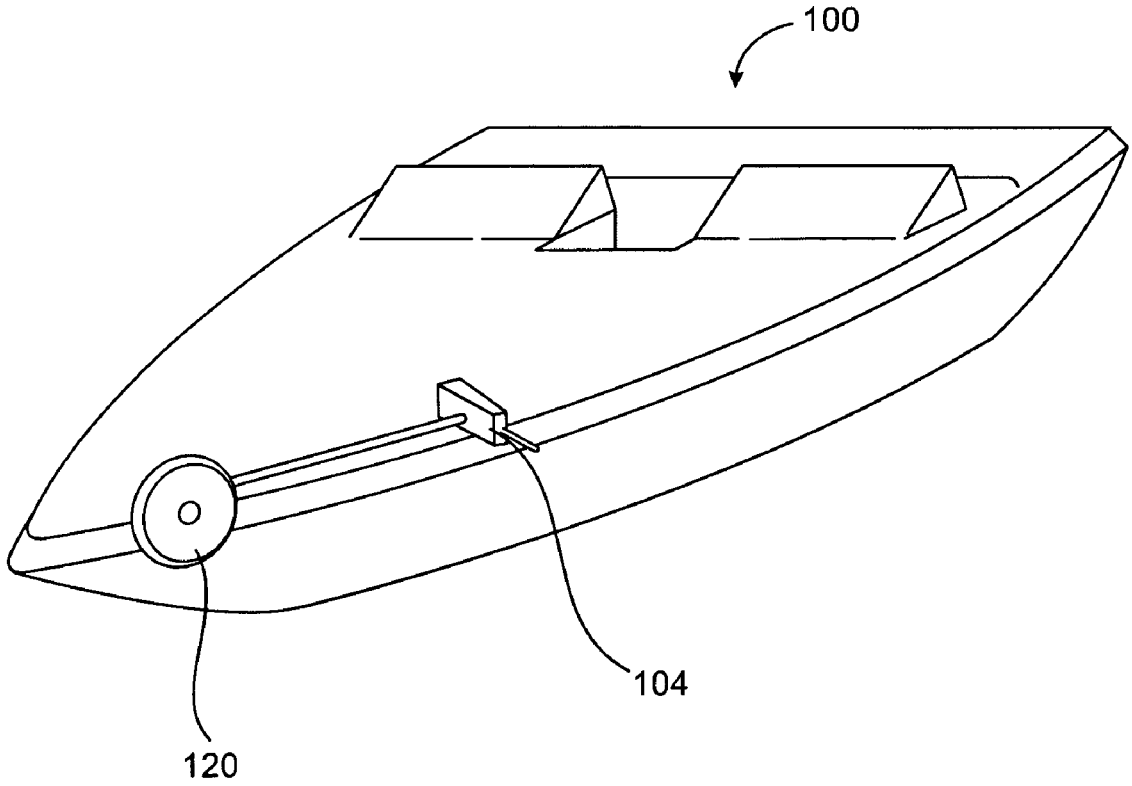
FIG. 2 shows a typical trolling motor on a boat with an example embodiment of the propeller cover of the invention installed over the blades.

FIG. 2 shows a typical trolling motor 104 on a boat 100 with an example embodiment of the propeller cover 120 of the invention installed over the blades. When a boat cover is placed over this boat the sharp edges of the blades will be prevented by the cover 120 from contacting and cutting or tearing the boat cover. The propeller cover 120 also prevents damage to other kinds of property, and protects individuals from injury, resulting from unintended contact with an uncovered boat propeller.

Figure 3:
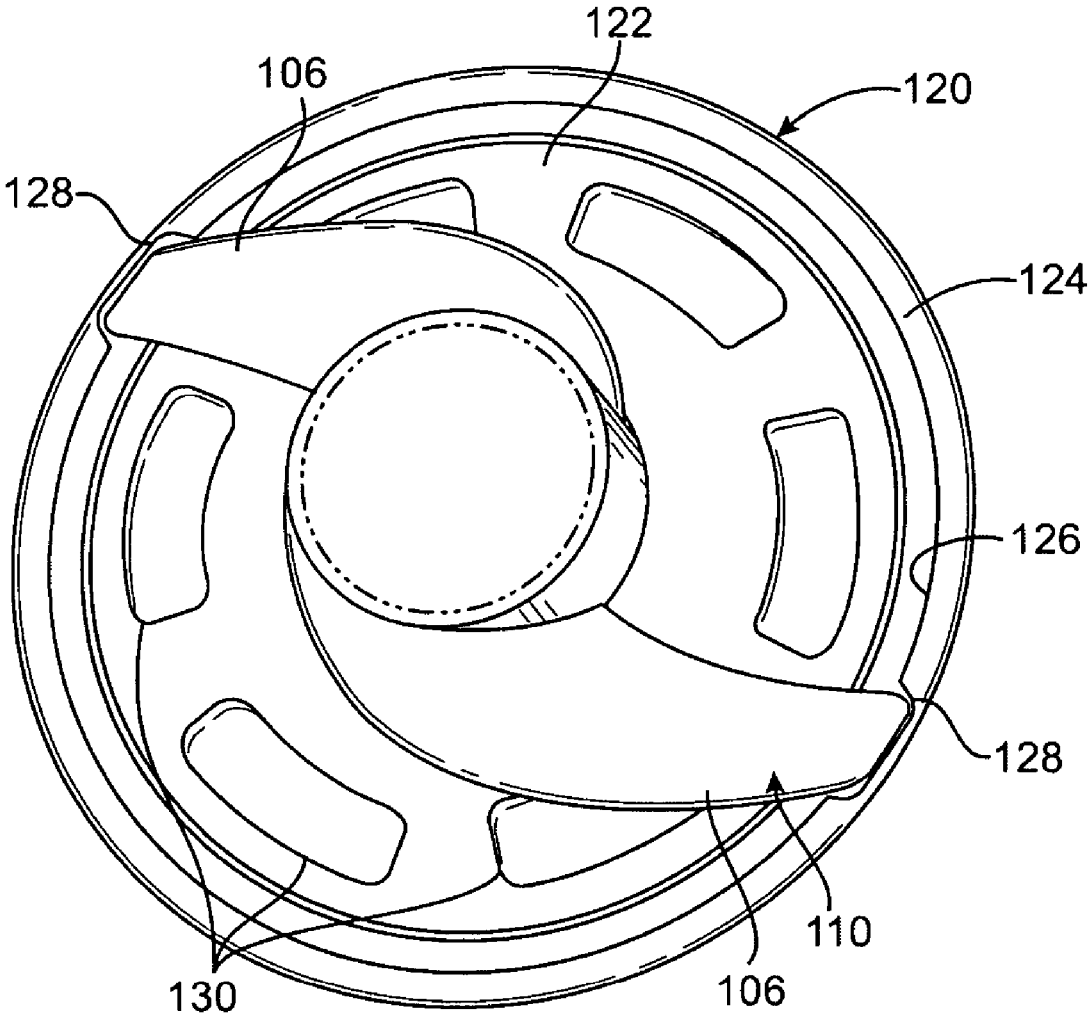
FIG. 3 shows a back view of an example embodiment of the propeller cover of the invention before attachemetn to a propeller.
Figure 4:
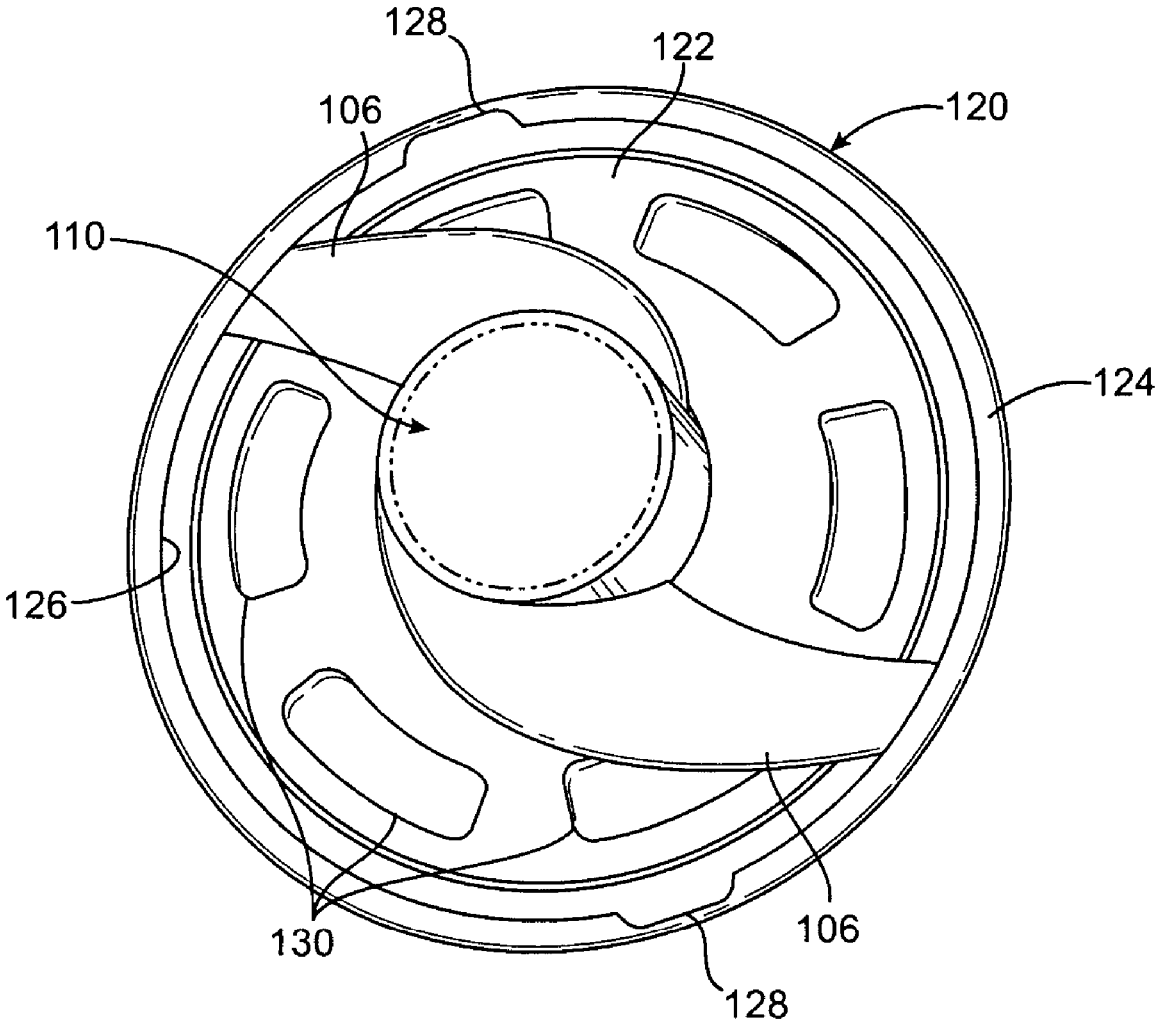
FIG. 4 shows a back view of the propeller cover after the propeller cover has been rotated onto a propeller.

A back view of one propeller cover embodiment of the invention is seen in FIG. 3. The propeller cover 120 in this embodiment comprises a front plate 122 having a flange 124 formed around the edge defining a channel 126 for accepting the ends of propeller blades 106. Notches 128 are formed in the flange 124 to allow the propeller 110 to be positioned in the propeller cover 120. The propeller cover 120 is then rotated so that the tips of the propeller blades 106 move to a position away from the notches 128, as seen in FIG. 4. Rotating the propeller 110 seats the propeller 110 in the propeller cover 120.

The channel 126 can be any desired shape suitable for receiving the tip of a propeller blade, but is U shaped in the embodiment seen in FIGS. 3 and 4. In preferred embodiments, the channel 126 is sized so that there is an interference fit between the propeller blades 106 and the flange 124 of the propeller cover 120 so that friction will prevent the propeller cover 120 from inadvertently rotating to a position that would allow the propeller cover 120 to fall off the propeller 110.

The propeller cover 120 may be manufactured from a variety of materials, but is preferably fabricated using a material that is tough, resilient, and resistant to weather and wear. One acceptable material may include polyurethane. Use of a resilient material may improve the interference fit between the propeller blades 106 and the propeller cover 120 enhancing the grip of the propeller cover 120 on the propeller blades 106.

The propeller cover 120 shown in FIGS. 3 and 4 is designed for a propeller 110 having two propeller blades 106. However, in alternate embodiments, the invention may be easily adapted for use on propellers with three or more blades by including additional notches appropriately positioned to accept all of the blades on the propeller.

The front surface of the propeller include features 130 in the embodiments shown in FIGS. 3 and 4, but may lack these features in other embodiments. Features 130 may be ridges formed in the front plate 122. The ridges may be used to stiffen or strengthen the front plate 122, and/or may be decorative in function. In alternate embodiments, the ridges may be of any size, shape, and number. In other embodiments the features 130 may be apertures or holes formed in the front plate 122. The holes may provide benefits which include but are not limited to reducing the weight of the propeller cover 120, providing decorative or ornamental design features, reducing cost by reducing the volume of material use to fabricate the propeller cover 120, and allowing airflow through the propeller cover 120. In alternate embodiments, the apertures may be of any size, shape, and number.

Figure 5:
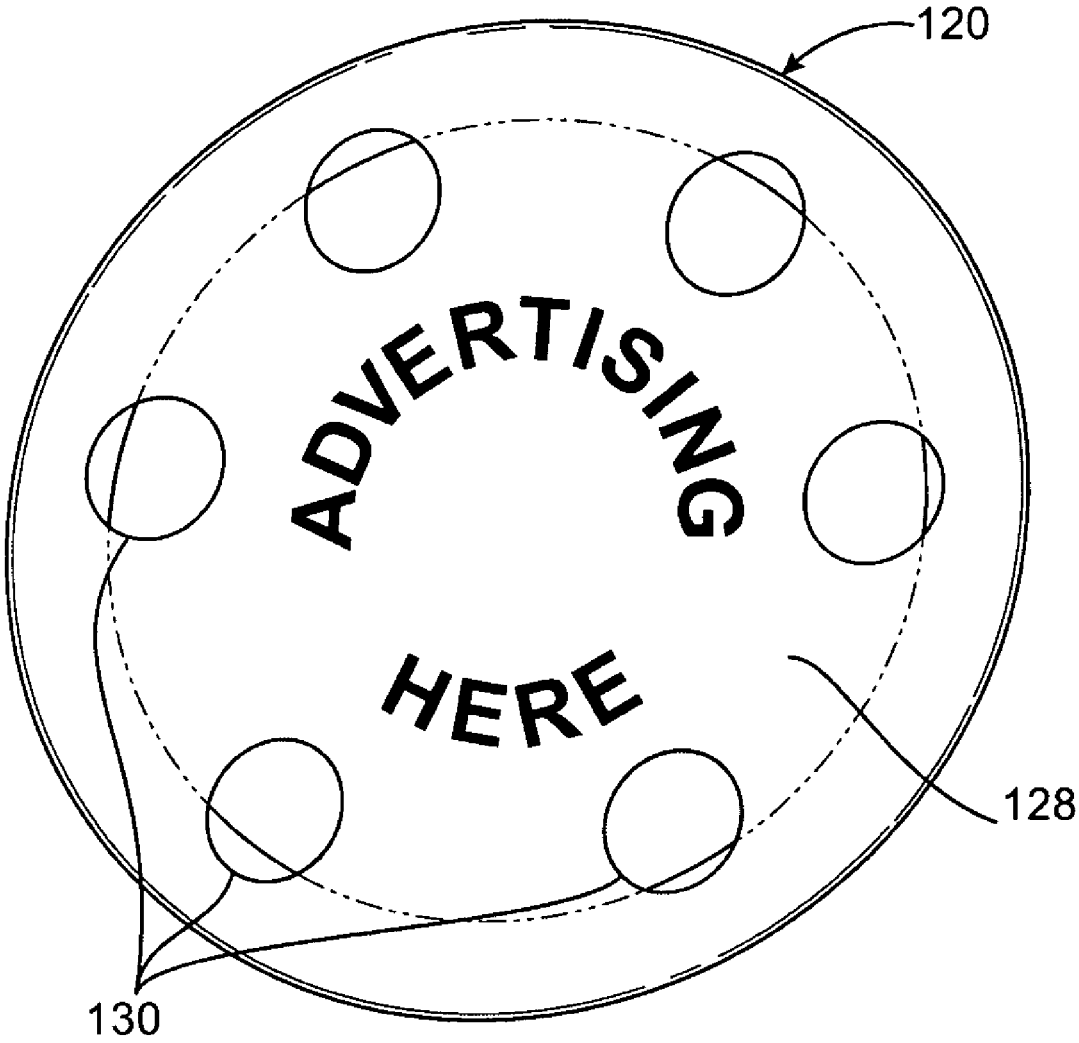
FIG. 5 shows a front view of another example embodiment of the propeller cover of the invention.

As previously mentioned, trolling motors are often mounted on the top of the boat. Therefore, propeller covers of the invention installed thereon may make ideal locations for prominently displaying graphical designs, trademarks and other displays. FIG. 5 shows an embodiment of the propeller cover 120 wherein the front plate 122 includes a region for printing advertising, and which also includes a set of decorative circular apertures 132 formed therein.

Figure 6:
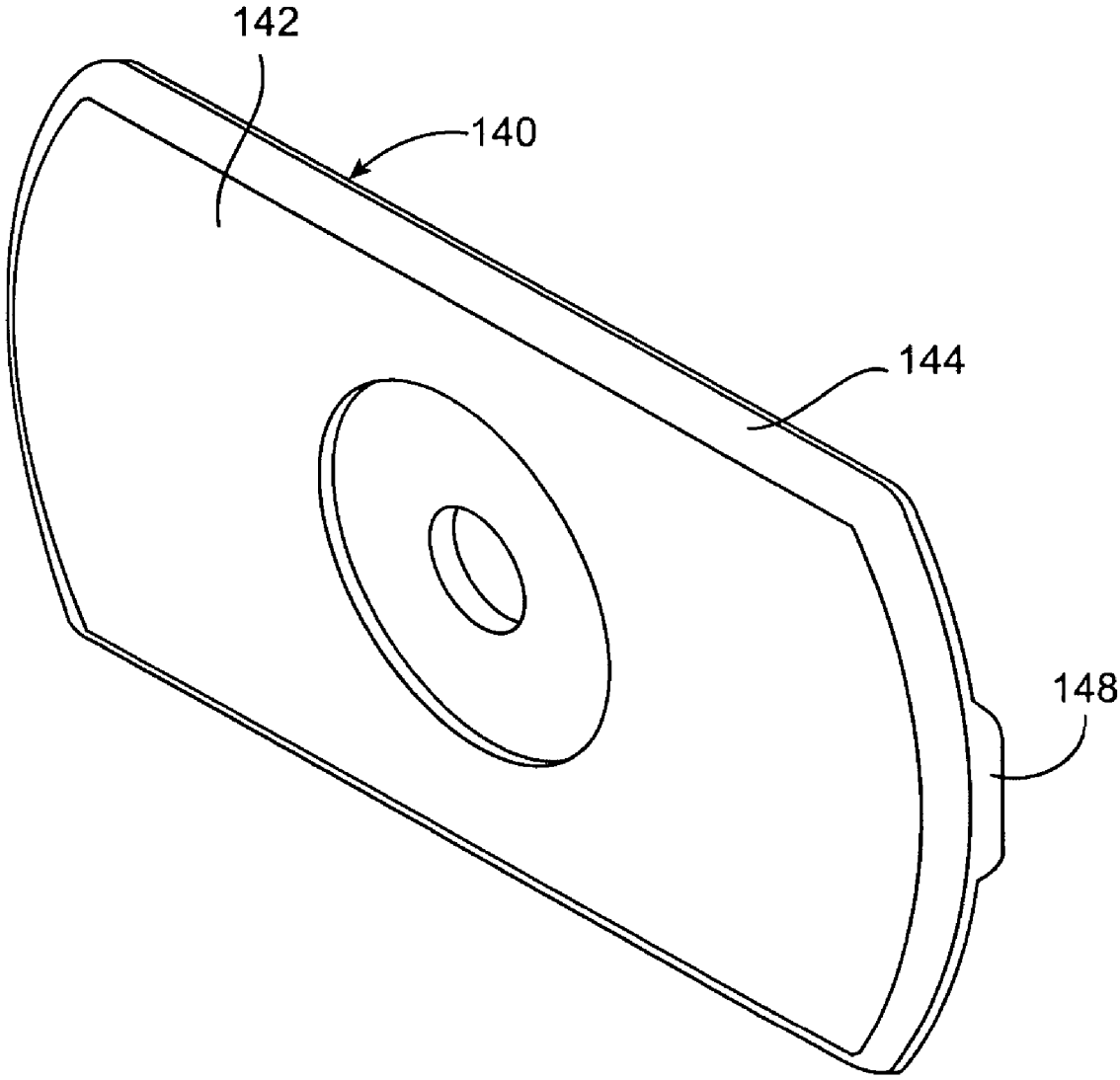
FIG. 6 shows a front perspective view of an example embodiment of the propeller cover of the invention fabricated specifically for use on a propeller having two blades.
Figure 7:
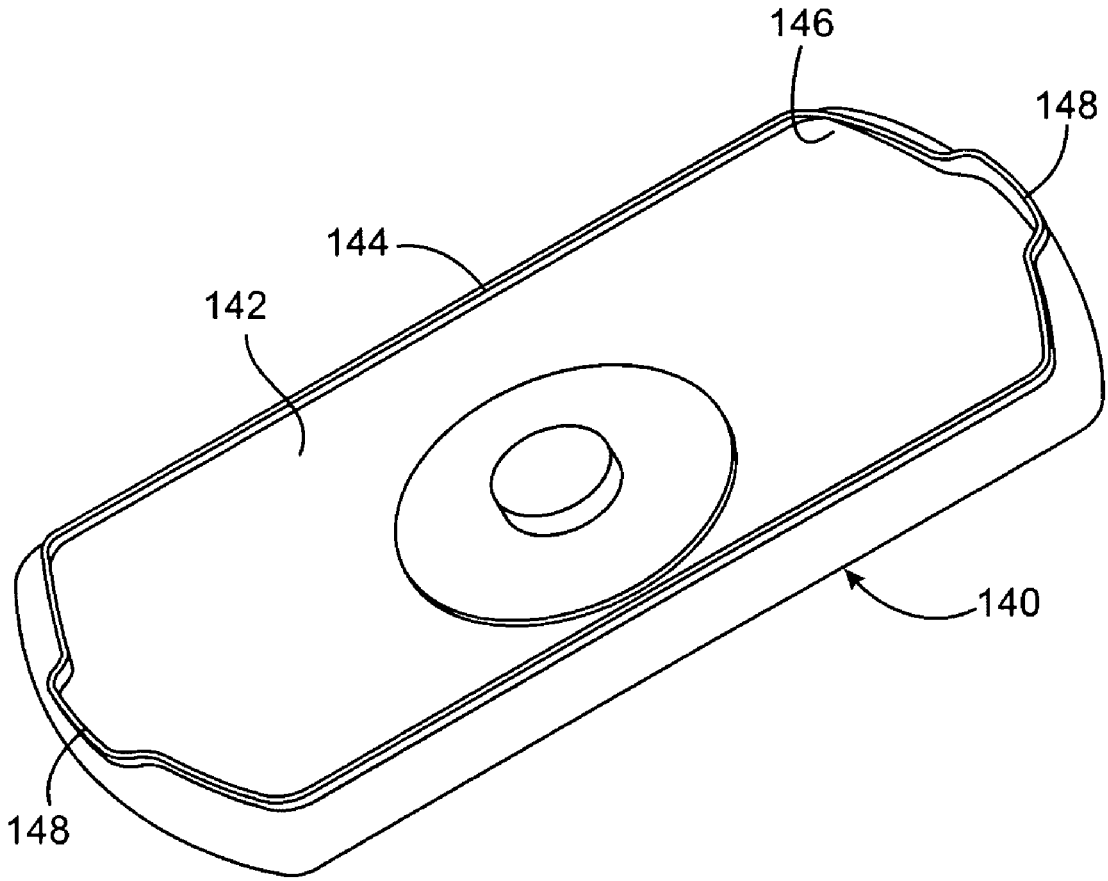
FIG. 7 shows a rear perspective view of the propeller cover of FIG. 6.

FIG. 6 shows a front perspective view of an example embodiment of the propeller cover of the invention designed for use specifically on a two blade propeller. FIG. 7 shows a rear perspective view of the propeller cover of FIG. 6. Portions of the round propeller cover of FIGS. 2 through 5 have been removed to provide an elongated shape propeller cover 140 that matches the shape of a two blade propeller more closely than the circular embodiments seen in FIGS. 2 through 5. This embodiment may provide advantages including but not limited to reducing the weight of the propeller cover, providing a different design appearance, reducing cost by reducing the volume of material use to fabricate the propeller cover, and reducing the probability that the propeller cover accidentally catches on something damaging the cover or causing the cover to pop off.

As in the previously described embodiments, the propeller cover 140 in this embodiment comprises a front plate 142 having a flange 144 formed around the edge defining a channel 146 (best seen in FIG. 7) for accepting the ends of propeller blades. Notches 148 are formed in the flange 144 to allow the propeller to be positioned in the propeller cover 140. The propeller cover 140 is then rotated so that the tips of the propeller blades move to a position away from the notches 148. Also as in previously discussed embodiments, the propeller cover 140 may include ridges and apertures.

In the embodiments seen in FIGS. 3 through 7, a user will select a propeller cover made to fit a particular size of propeller. In other embodiments the propeller cover may be adjustable for use on a number of different sized propellers.

Figure 8:
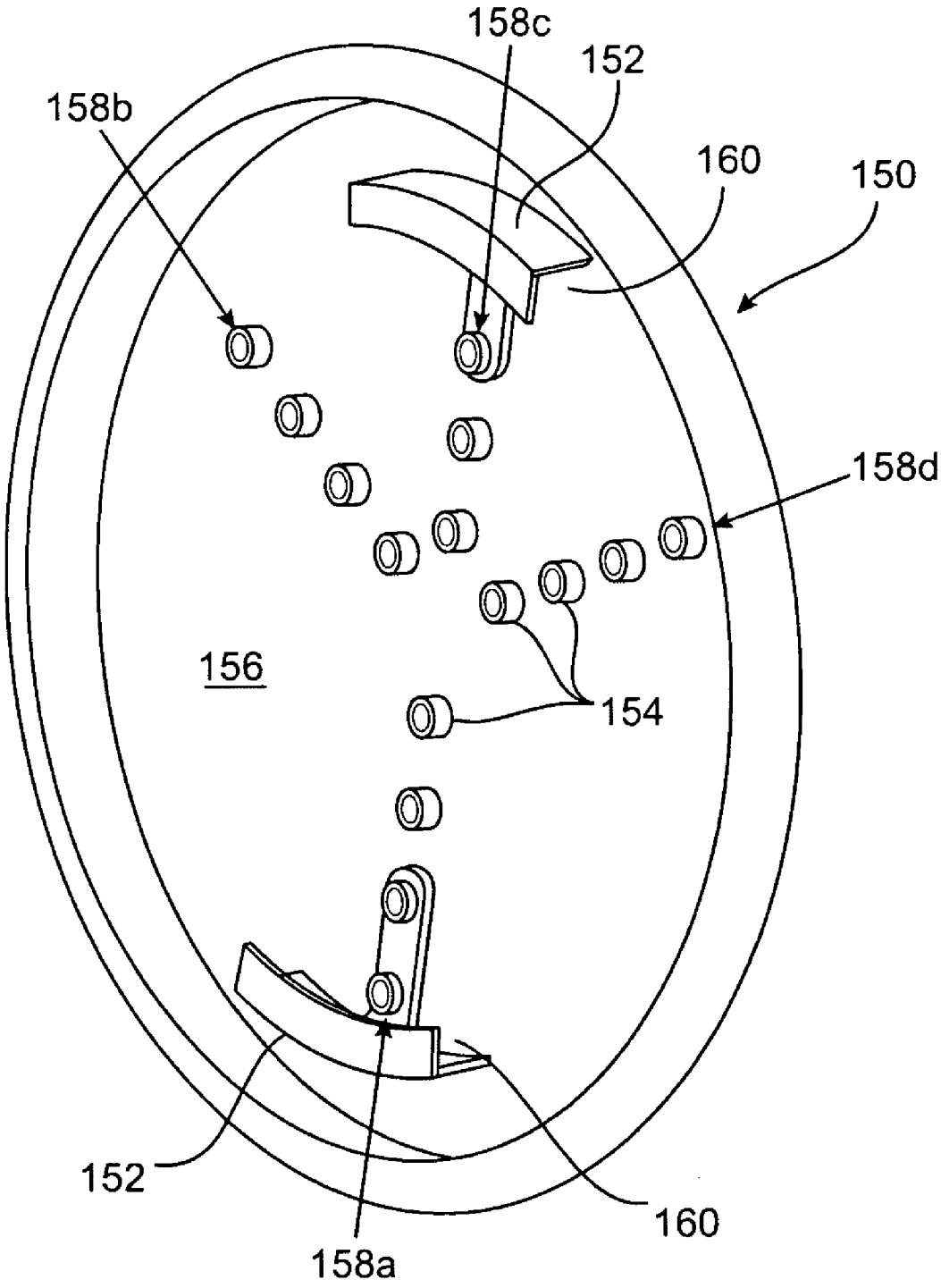
FIG. 8 shows a rear perspective view of an embodiment of the invention including apparatus for adjusting the propeller cover to fit a variety of propeller sizes.
Figure 9:
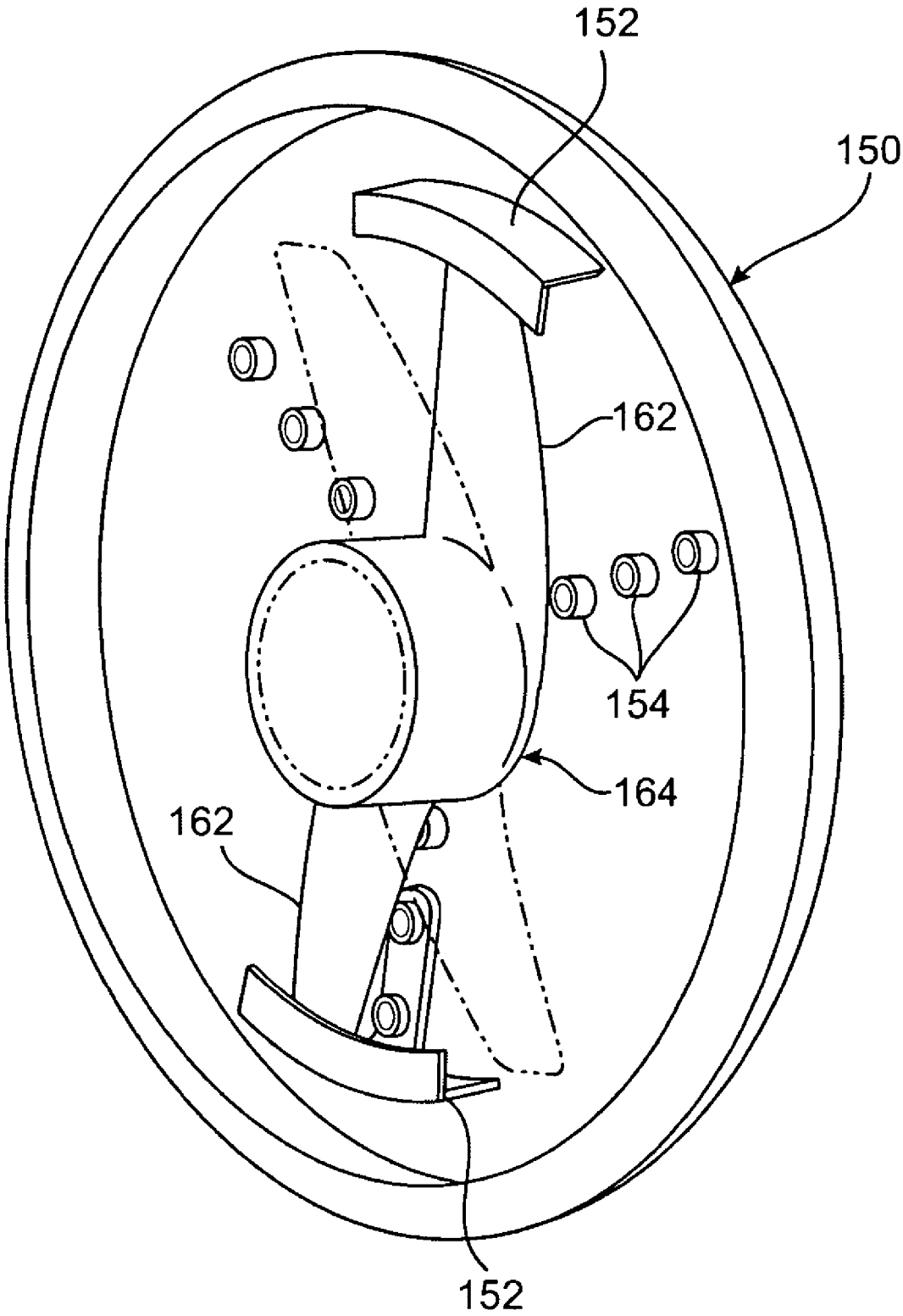
FIG. 9 shows the embodiment of FIG. 8 being installed on a propeller blade.

An example adjustable propeller embodiment is see in FIGS. 8 and 9. FIG. 8 is a rear perspective view of an embodiment of the propeller cover 150 including two propeller blade catches 152 affixed to the back side of the front plate 156. The propeller blade catches 152 each include a channel 160 sized to receive the tips of the propeller blades 162 (seen in FIG. 9). In the embodiment shown, the propeller blade catches 152 are snapped onto dimples, generally 154, formed on the back side of the front plate 156. However, the invention is not intended to be limited by the attachment means shown. Rather, any useable method for attachment of the propeller blade catches 152 is intended to be within the scope of the invention including but not limited to the use of, grooves, adhesives, and other attachment apparatus.

Referring to FIG. 8, the dimples 154, allow installation and positioning of the blade catches 152 to match the propeller size on which the propeller cover 150 is intended to be used. There are four rows of dimples, namely 158*a*, 158*b*, 158*c*, and 158D. FIG. 8 shows the propeller cover 150 adapted to fit on a two blade propeller. Two propeller blade catches 152 are installed opposite each other on dimple line 154*a* and dimple line 154*c*. If the propeller instead included three blades, then three propeller blade catches 152 would be used, with one installed on dimple line 154*a*, the second on dimple line 154*b*, and the third on dimple line 154*d*. In alternate embodiments, the invention can be easily adapted for propellers having four or more blades as well.

FIG. 9 shows the propeller cover of FIG. 8 being installed on a propeller cover. The propeller 164 is positioned in the propeller cover 150 with the blades 162 beside the catches 152. The relative position of the propeller blade 106 and the propeller 164 cover 150 is then rotated so that the tips of the propeller blades 162 enter the channels 160, seating the propeller 164 in the propeller cover 150. The propeller blades 162 are preferably held in place by an interference fit within the channel 160, so that friction will tend to prevent the propeller 164 from rotating out of the propeller blade catches 152.

In some embodiments, the propeller covers built in accord with this invention may be incorporated into or attached to other objects and shapes. Thus, for example, a decorative fish shape could include the propeller cover of the invention incorporated in its design, allowing attachment of the decorative shape to the blades of the propeller.

The above described embodiments are provided as examples. Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A cover for a propeller with at least two propeller blades, the cover for a propeller comprising:

a front plate having an edge, and a flange formed around said edge of said front plate, said flange defining a channel to receive the blades of the propeller, said channel further comprising at least one notch.

2. The cover for a propeller of claim 1 further comprising at least two notches.

3. The cover for a propeller of claim 1 comprising one notch for each propeller blade on the propeller.

4. The cover for a propeller of claim 1 wherein only a tip of each blade of the propeller is received within said channel.

5. The cover for a propeller of claim 1 further comprising an interference fit between the propeller blades and said flange defining said channel.

6. The cover for a propeller of claim 1 further comprising ridges formed in said front plate.

7. The cover for a propeller of claim 1 further comprising apertures formed in said front plate.

8. The cover for a propeller of claim 1, further comprising at least one decorative shape coupled to said front plate.

9. The cover for a propeller of claim 1, wherein said cover is incorporated into a decoratively shaped object.

10. The cover for a propeller of claim 1 further comprising a display printed on said front plate.

11. A cover and propeller assembly including a cover attached to a propeller including at least two propeller blades, said cover and propeller assembly comprising:

a propeller cover including a front plate having an edge, and a flange formed around said edge of said front plate, said flange defining a channel to receive the blades of a propeller, said channel further comprising at least one notch to allow a tip of said blade access to said channel, and a propeller having at least 2 blades, each said blade received within said channel.

12. A cover for a propeller with at least two propeller blades, the cover for a propeller comprising:

a front plate at least one propeller blade catch adjustably coupled to a back surface of said front plate, said propeller blade catches including a channel to receive the blades of the propeller.

13. The cover for a propeller of claim 12 further comprising at least two propeller blade catches.

14. The cover for a propeller of claim 12 further comprising at least three propeller blade catches.

15. The cover for a propeller of claim 13 wherein a position of said propeller blade catches are be adapted to received a propeller having a selected size.

16. The cover of claim 14 wherein a position of said propeller blade catches are adapted to received a propeller having a selected number of propeller blades.

17. The cover for a propeller of claim 12, further comprising at least one element selected from the group consisting of: a decorative shape coupled to said front plate, and a display printed on said front plate.

18. The cover for a propeller of claim 12, wherein said cover is incorporated into a decoratively shaped object.

19. The cover for a propeller of claim 12 wherein said at least one propeller blade catch is removeably attachable.

* * * * *